US005813477A

United States Patent [19]

Clay et al.

[11] Patent Number: 5,813,477

[45] Date of Patent: Sep. 29, 1998

[54] VIBRATION-REDUCED IMPACT TOOL AND VIBRATION ISOLATOR THEREFOR

[75] Inventors: John D. Clay, New Hartford; Paul Bilodeau, Frankfort, both of N.Y.; Robert J. Michael, Erie, Pa.

[73] Assignees: Chicago Pneumatic Tool Company, Utica, N.Y.; The Lord Corporation, Erie, Pa.

[21] Appl. No.: 653,728

[22] Filed: May 23, 1996

[51] Int. Cl.[6] ..... B25D 9/04

[52] U.S. Cl. ..... 173/1; 173/211; 173/162.1; 267/140

[58] Field of Search ..... 173/1, 162.1, 162.2, 173/210, 211; 267/137, 140

[56] References Cited

U.S. PATENT DOCUMENTS

| | | | |
|---|---|---|---|
| 2,058,583 | 10/1936 | Forss . | |
| 2,500,036 | 3/1950 | Horvath . | |
| 2,831,463 | 4/1958 | Ekstrom et al. . | |
| 3,652,074 | 3/1972 | Frederickson et al. | 267/137 |
| 3,876,244 | 4/1975 | Haberle et al. | 267/140 |
| 3,911,580 | 10/1975 | Bailey | 173/162.1 |
| 3,968,843 | 7/1976 | Shotwell | 173/210 |
| 3,989,293 | 11/1976 | Haberle et al. | 267/140 |
| 4,084,801 | 4/1978 | Landers et al. | 267/140 |
| 4,135,301 | 1/1979 | Hoeppner | 30/381 |
| 4,401,167 | 8/1983 | Sekizawa et al. . | |
| 4,565,313 | 1/1986 | Buck et al. . | |
| 4,723,610 | 2/1988 | Dummermuth et al. | 173/162.1 |
| 4,776,408 | 10/1988 | Elkin et al. . | |
| 4,867,366 | 9/1989 | Kleinholz . | |
| 4,932,480 | 6/1990 | Golsch | 172/210 |
| 5,052,499 | 10/1991 | Dobry et al. . | |
| 5,054,562 | 10/1991 | Honsa et al. . | |
| 5,311,948 | 5/1994 | Kimberlin . | |
| 5,322,131 | 6/1994 | Pressley et al. . | |
| 5,327,636 | 7/1994 | Wilson . | |
| 5,370,193 | 12/1994 | Sippus et al. . | |
| 5,400,860 | 3/1995 | Best et al. . | |
| 5,407,018 | 4/1995 | Henry . | |
| 5,417,294 | 5/1995 | Suher . | |
| 5,431,235 | 7/1995 | Drumhelle et al. . | |
| 5,441,192 | 8/1995 | Sugita et al. . | |
| 5,485,887 | 1/1996 | Mandanis . | |

FOREIGN PATENT DOCUMENTS

| | | |
|---|---|---|
| 0207034 | 6/1986 | European Pat. Off. . |
| WO94/16864 | 8/1994 | WIPO . |

*Primary Examiner*—Scott A. Smith
*Attorney, Agent, or Firm*—Schmeiser, Olsen & Watts

[57] ABSTRACT

A vibration-reduced impact tool is disclosed wherein an elastomeric vibration isolator is fixedly attached within the tool housing and functions to absorb the vibration typically transmitted from the handle to the operator. The isolator is mounted between the cylinder assembly and the handle. As the tool is operated, a piston within the cylinder assembly is driven forward where it impacts with a tool accessory. The impact causes the piston and cylinder assembly to slide rearward in the tool housing, toward the handle. The elastomeric isolator absorbs the rearward movement of the cylinder assembly and thereby eliminates much of the vibration normally transmitted from the cylinder assembly to the handle and in turn, to the operator.

13 Claims, 2 Drawing Sheets

VIBRATION-REDUCED IMPACT TOOL AND VIBRATION ISOLATOR THEREFOR

FIELD OF THE INVENTION

1. Technical Field

This invention relates generally to the field of impact tools and more specifically to a pneumatic impact tool, such as a riveter and vibration isolator therefor.

2. Background Art

Pneumatic ("air") impact tools are hand-held power tools used in various industries. As is well-known in the art, the tool housing includes an inner chamber enclosing a cylinder assembly having a piston reciprocally movable therein. Various accessories can be mounted on the nose of the tool. As compressed air enters the inner chamber of the housing from the handle of the tool, the piston reciprocates forward in the cylinder assembly until it impacts with an accessory that has been mounted on the tool's nose and the accessory then impacts with a work piece. The striking action of the piston on the accessory causes the piston and the cylinder assembly to recoil, traveling rearward in the housing, toward the handle.

Thus, it is desirable to provide a vibration isolator that can function to absorb the vibration transmitted to the tool handle and in turn to the operator due to the rearward recoil of the piston and cylinder assembly. It is also desirable to provide a vibration isolator that can be utilized with existing pneumatic impact tool construction and that employs minimal number of components.

U.S. Pat. No. 4,776,408, issued Oct. 11, 1988 to Elkin et al., discloses a pneumatic impact tool having a cushioning assembly for cushioning the repeated recoil of a hammer piston. The cushioning assembly comprises a plurality of parts, including an energy-dissipating damping sub-assembly and an energy-storing coil spring sub-assembly arranged in series to operate independently and simultaneously to cushion the piston's rearward movement.

U.S. Pat. No. 5,441,192, issued Aug. 15, 1995 to Sugita et al., discloses a fastener driving tool which includes a ring bumper which functions as a shock absorber of a piston to prevent "double-driving" of the tool. The ring bumper is positioned within the forward end of the cylinder, forward of the piston. As the tool is operated, the piston will be driven forward, striking the bumper, which then moves forward, preventing a repeated drive of the piston.

U.S. Pat. No. 5,400,860, issued Mar. 28, 1995 to Best et al., discloses an apparatus for reducing vibration transmission in hand-held tools. The apparatus is comprised of a multitude of components, including a male frustroconical portion whose tip is located facing a female bed and wherein the base of the male portion is attached to the tool handle and the female portion is attached to the working end of the tool. Retained between the tip of the male portion and the female portion are three rubber balls. As the female portion moves in relation to the working end of the tool, the rubber balls act as vibro-isolators.

U.S. Pat. No. 5,407,018, issued Apr. 18, 1995 to Henry, discloses a multi-part vibration and noise attenuation means interposed between the front end of a hollow tool housing and the reciprocating impact member. The attenuation means has a laminar configuration, formed with a first outer layer of solid elastomeric material, a rigid metal inner layer and a second outer layer of solid elastomeric material.

SUMMARY OF THE INVENTION

It is an advantage of the present invention to provide a pneumatic impact tool capable of reducing the vibration transmitted from the tool to the operator of the tool.

It is another advantage of the present invention to provide an elastomeric isolator for use with a pneumatic impact tool which is durable, having optimal wear and oil resistance, and which provides superior damping value, while maintaining satisfactory tool "feel".

It is a further advantage of the present invention to provide a method for reducing the vibration transmitted from the handle of a pneumatic impact tool to the operator by providing an elastomeric isolator which is comprised of minimal components and which is inexpensive to manufacture.

It is still another advantage of the present invention to provide an elastomeric isolator for use with a pneumatic impact tool which can easily be integrated into existing pneumatic impact tool technology.

The foregoing and other features and advantages of the present invention will be apparent from the following more particular description of a preferred embodiment of the invention, as illustrated in the accompanying drawings.

BRIEF DESCRIPTION OF THE DRAWINGS

The preferred exemplary embodiment of the present invention will hereinafter be described in conjunction with the appended drawings, wherein like reference designations denote like elements, and.

DETAILED DESCRIPTION OF THE DRAWINGS

Referring now specifically to the drawings, there is illustrated a vibration-reduced impact tool, generally designated as 10. Impact tool 10 can be any hand-held, piston-driven tool, such as a chipper, hammer, tamper, jackhammer, riveter or the like. The tool can have various type handles, such as a pistol-grip or straight line. For purposes of illustration, the present invention will be described in terms of a pneumatic riveter, having a pistol-grip.

Figure 1:
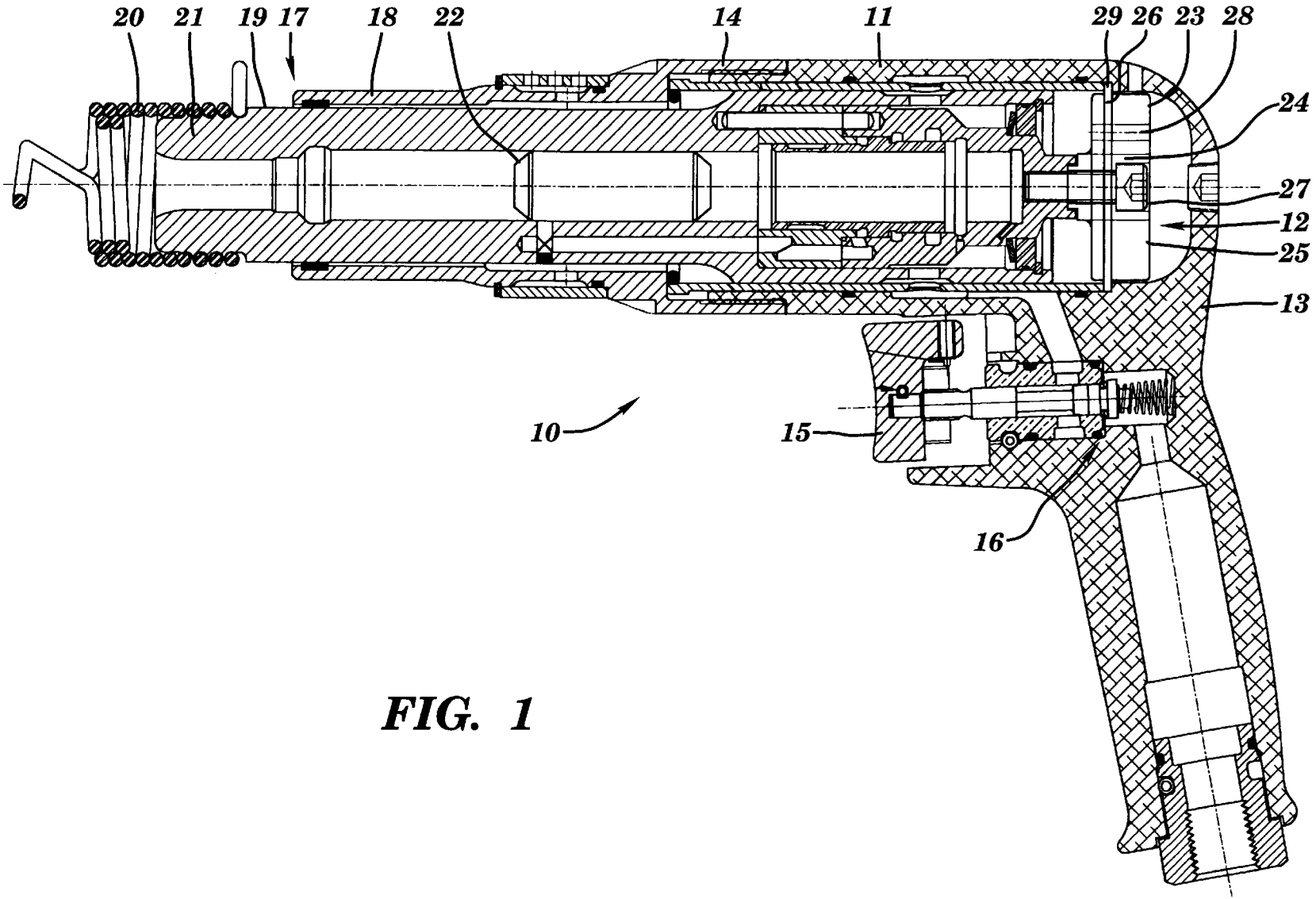
FIG. 1 shows a cut-away view of the impact tool and elastomeric vibration isolator according to a preferred embodiment of the present invention.
Figure 2:
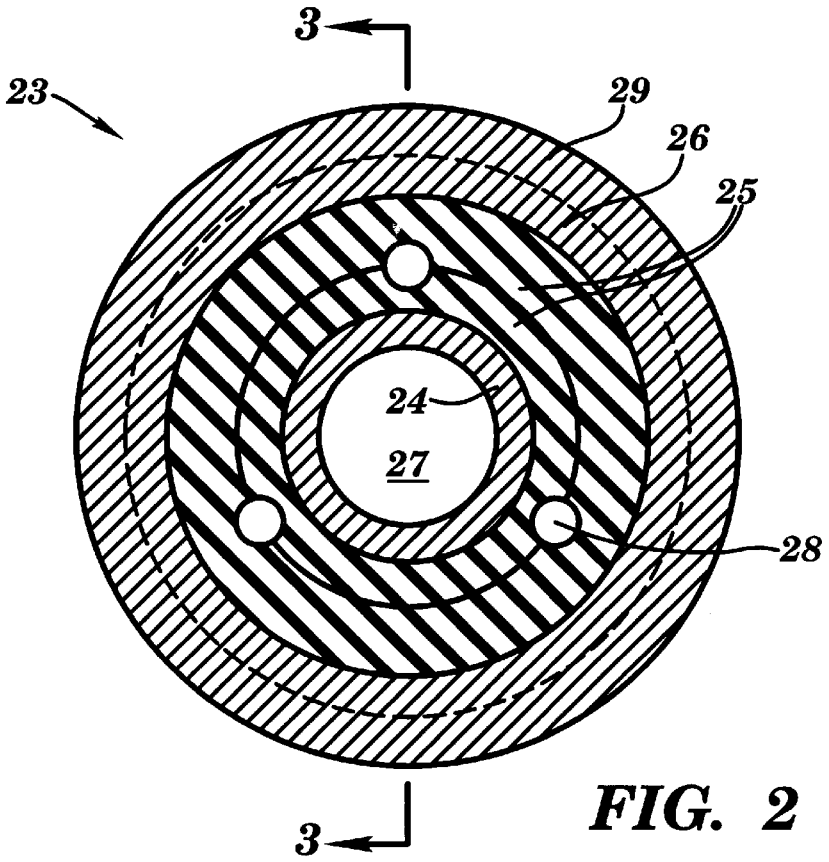
FIG. 2 shows a front view of the elastomeric vibration isolator according to a preferred embodiment of the present invention.
Figure 3:
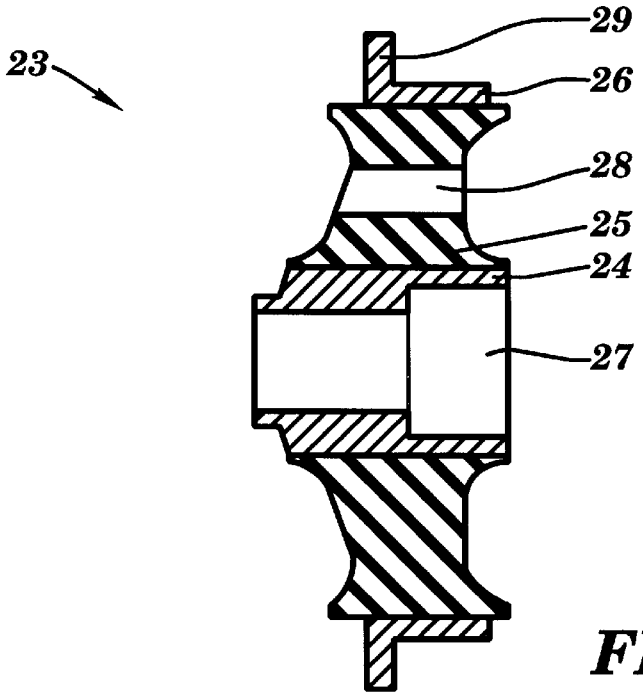
FIG. 3 shows a cross-sectional view, taken along line 3—3 of FIG. 2, of the elastomeric vibration isolator according to a preferred embodiment of the present invention.

Referring now to FIG. 1, tool 10 comprises a housing 11 with an inner chamber 12, a handle portion 13, and a housing nose portion 14. Handle portion 13 includes a throttle 15, which functions to control the operation of tool 10. In this illustration, throttle 15 controls the flow of compressed air from assembly 16, to power tool 10.

Positioned along the longitudinal axis of inner chamber 12 is cylinder assembly 17, which is comprised of cylinder housing 18 and cylinder 19. Cylinder housing 18 lies adjacent to the inner surface of housing 11 and extends beyond housing 11. Cylinder 19 is reciprocally movable within cylinder housing 18 and extends beyond cylinder housing 18. Retainer 20 is fitted over exposed cylinder nose portion 21 to provide a point of attachment for various accessories, depending on the work piece tool is being used with.

Reciprocally movable from a forward position, impacting with retainer 20, and a rearward position proximate handle portion 13, is a piston 22. The impact force of piston 22 drives the accessory, in this example, a riveter accessory.

Positioned within inner chamber 12 of housing 11, distal from housing nose portion 14 and proximate handle portion 13, is an elastomeric vibration isolator 23. Vibration isolator 23 is comprised of an inner member 24, an elastomeric member 25 and an outer member 26. Inner member 24 is preferably formed of a material having the characteristics of steel and tube-shaped and has an aperture 27 for receiving a fastener such as a cap screw.

Surrounding the circumferential periphery of inner member 24 is the elastomeric member 25, the working component of vibration isolator 23. Elastomeric member 25 is preferably formed of a neoprene elastomer rubber, although other materials are recognized. The use of neoprene rubber provides optimal durability and oil resistance. A plurality of apertures 28 are molded into the elastomer body to allow air passage. A shoulder is also molded into the elastomeric member, to improve vibration dampening. Encircling elastomeric member 25 is outer member 26, which, similar to inner member 24, is preferably formed of a material having the characteristics of steel. Outer member 26 includes a flange 29 which provides a second point of attachment to vibration isolator 23.

When operatively positioned within housing 11, inner member 24 will be attached to the rearward portion of cylinder assembly 17 by means of a screw passing through aperture 27 into cylinder 19, and outer member 26 will be attached within the tool and, hence, to handle portion 13, by means of flange 29 e.g., by clamping of flange 29 between two members affixed within, or part of, the housing 11. Thus, elastomeric vibration isolator 23 elastically couples the cylinder assembly 17 to the handle portion 13 of housing 11, allowing relative motion between the two, resulting in handle isolation and a reduction in the vibration transmitted to the operator.

Now that one is familiar with the construction of the impact tool and elastomeric vibration isolator of the present invention, the method of operation will be described.

In practice, the tool operator will depress throttle 15, engaging assembly 16 and initiating the flow of compressed air through handle 13 into cylinder assembly 17. The force of compressed air causes piston 22 to reciprocate forward within cylinder 19 until it impacts with the accessory held by retainer 20. This striking action causes piston 22 and cylinder 19 to reciprocate in a rearward direction, toward handle 13 and the tool operator. Without elastomeric vibration isolator 23, cylinder 19 would strike handle 13 directly and this vibration would be transmitted to the tool operator. However, in the tool of the present invention, the recoiling movement of cylinder 19 is absorbed by the elastomeric member 25 of isolator 23 and handle 13 is thereby isolated from vibration.

The embodiments disclosed herein have been discussed for the purpose of familiarizing the reader with the novel aspects of the invention. Although preferred embodiments of the invention have been shown, many changes, modifications and substitutions may be made by one of ordinary skill in the art without necessarily departing from the spirit and scope of the invention as described in the following claims.

I claim:

1. A vibration-reduced impact tool comprising:

a cylinder assembly operatively assembled within said tool;

a piston operatively positioned within said cylinder assembly, wherein said piston is reciprocally movable between a forward and rearward position;

means, operatively connected to said piston, for driving said piston; and an elastomeric isolator operatively coupled to the cylinder assembly and affixed within said tool, said elastomeric isolator including:

an inner member;

an elastomeric member surrounding a circumferential periphery of said inner member; and an apertureless outer flanged member extending radially outward from said elastomeric member.

2. The impact tool of claim 1, wherein said means for driving said piston is compressed air.

3. The impact tool of claim 1 wherein said inner and outer members are formed of steel and said elastomeric member is formed of neoprene rubber.

4. The vibration-reduced impact tool of claim 1, wherein said inner member is substantially tubular, said outer member is circumferentially affixed to the periphery of said elastomeric member, and said elastomeric member includes a plurality of apertures extending therethrough.

5. The vibration-reduced impact tool of claim 1, wherein the elastomeric isolator is affixed within said tool by connection between a first member and second member.

6. An elastomeric isolator in combination with a vibration-reduced impact tool, said tool including a housing having an inner chamber for operatively housing a cylinder assembly, the elastomeric isolator comprising:

an inner member operatively attached to the cylinder assembly;

an elastomeric member surrounding a circumferential periphery of said inner member, said elastomeric member having a plurality of apertures extending therethrough; and an outer member affixed to a circumferential periphery of said elastomeric member wherein a flange of said outer member extends outwardly from said elastomeric member and is operatively attached to the tool.

7. The elastomeric isolator and tool of claim 6, wherein said inner and outer members are formed of steel and said elastomeric member is formed of neoprene rubber.

8. The elastomeric isolator and tool of claim 6, wherein the inner member is substantially tube-shaped.

9. A method for reducing vibration transmitted from a handle of an impact tool to an operator said method comprising the step of:

providing an impact tool having:

a housing having an inner chamber;

a cylinder assembly operatively assembled within said inner chamber of said housing;

a piston operatively positioned within said cylinder assembly, wherein said piston is reciprocally movable between a forward and rearward position;

means, operatively connected to said piston, for driving said piston; and a handle operatively connected to said housing;

providing an elastomeric isolator comprising:

an inner member having an aperture extending therethrough;

an elastomeric member surrounding a circumferential periphery of said inner member, said elastomeric member having a plurality of apertures extending therethrough; and an outer member affixed to a circumferential periphery of said elastomeric member wherein a flange of said outer member extends outwardly from said elastomeric member; and affixing said elastomeric isolator, within said inner chamber of said housing, to each of said cylinder assembly and said tool to absorb vibration caused by rearward movement of said piston.

10. The method of claim 9, wherein said step of affixing said elastomeric isolator within said housing further includes the step of:

affixing said inner member to said cylinder by means of a screw passing through said aperture of said inner member; and affixing said flange of said outer member to said housing.

11. The method of claim 9, wherein the step of providing an inner member includes providing a substantially tube-shaped member.

12. A vibration-reduced impact tool comprising:

a housing having an inner chamber;

a cylinder assembly operatively assembled within said tool;

a piston positioned for reciprocal movement within said cylinder assembly and displaceable between a forward and rearward position;

means for operatively driving said piston;

an elastomeric isolator mounted relative to said cylinder assembly and said housing, said isolator including:

i) an inner member having an outer peripheral surface, said inner member affixed through a central aperture to said cylinder assembly, ii) an outwardly extending apertureless flanged outer member clamped to a portion of said housing and including an inner peripheral surface, and iii) an elastomeric member bonded between said inner and outer peripheral surfaces.

13. A vibration-reduced impact tool comprising:

a housing having an inner chamber;

a cylinder assembly operatively assembled within said tool;

a piston positioned for reciprocal movement within said cylinder assembly and displaceable between a forward and rearward position;

means for operatively driving said piston;

an elastomeric isolator mounted relative to said cylinder assembly and said housing, said isolator including:

i) an inner member having an outer peripheral surface, said inner member affixed through a central aperture to said cylinder assembly, ii) an outwardly extending flanged outer member clamped to a portion of said housing and including an inner peripheral surface, and iii) an elastomeric member bonded between said inner and outer peripheral surface and including at least one aperture extending therethrough.

* * * * *